United States Patent [19]

Wrinkle

[11] Patent Number: 4,531,729

[45] Date of Patent: Jul. 30, 1985

[54] EXERCISE BAR

[75] Inventor: Rodney P. Wrinkle, Olathe, Kans.

[73] Assignee: Fitness Products, Inc., Olathe, Kans.

[21] Appl. No.: 476,487

[22] Filed: Mar. 18, 1983

[51] Int. Cl.[3] ..... A63B 13/00

[52] U.S. Cl. ..... 272/123; 272/143

[58] Field of Search ..... 272/123, 122, 124, 128, 272/143, 116, 93; 81/177 B

[56] References Cited

U.S. PATENT DOCUMENTS

| | | | |
|---|---|---|---|
| 463,206 | 9/1891 | Somerby . | |
| 1,013,782 | 1/1912 | Koch . | |
| 1,176,365 | 3/1916 | Hartnett | 272/71 |
| 1,386,206 | 8/1921 | Samuelson | 272/73 |
| 2,416,471 | 2/1947 | De Chappedelaine | 272/73 UX |
| 2,508,567 | 5/1950 | Dymeck | 272/123 |
| 2,630,332 | 3/1953 | Pettijohn | 272/73 X |
| 2,676,802 | 4/1954 | O'Brien . | |
| 2,722,419 | 11/1955 | Tarapczynski | 272/123 |
| 3,685,511 | 8/1972 | Alvarez | 272/73 X |
| 3,756,597 | 9/1973 | Monti . | |
| 3,904,198 | 9/1975 | Jones . | |
| 4,288,073 | 9/1981 | Petrachonis et al. . | |

*Primary Examiner*—Richard J. Apley
*Assistant Examiner*—William R. Browne
*Attorney, Agent, or Firm*—Schmidt, Johnson, Hovey & Williams

[57] ABSTRACT

A rotary exercise bar presenting an elongated central shaft, a pair of elongated handgrip portions oriented parallel and co-planar with the longitudinal axis of the central shaft, but offset on opposite sides thereof, and a pair of elongated, weight-receiving members coaxial with the central shaft and secured, respectively, to the outboard ends of the handgrip portions. The handgrip portions each employ an elongated, tubular handle revolubly mounted thereon, and the handgrip portions are each secured between the central shaft and the respective weight-receiving member by a pair of obliquely-oriented connector elements. Each weight-receiving member is adapted to have conventional free weights secured thereto, if desired. In use, the bar handles are grasped in the respective hands and the handles revolved around the central shaft. Free weights are added to the weight-receiving members, as desired, to increase the exercise resistance.

7 Claims, 7 Drawing Figures

EXERCISE BAR

BACKGROUND OF THE INVENTION

1. Field of the Invention

This invention relates to an exercise bar of a simple, yet highly effective design which, by rotating the bar about its central axis, simultaneously exercises contralateral antagonist muscle groups in a balanced fashion. Use of the bar of the present invention is of a particular advantage in many types of strength, toning, and rehabilitative exercise programs. Preferably, the invention is concerned with an exercise bar having an elongated central shaft, a pair of handgrip portions disposed on either side of the central shaft, and a pair of weight-receiving members respectively secured to each end of the bar outboard of the handgrips. The weight-receiving members adapted for receiving conventional free weights, as desired, to increase the exercise resistance.

2. Description of the Prior Art

Conventional exercise bars basically consist of a straight, elongated, cylindrical bar to which a plurality of conventional free weights may be affixed at each end. Use of this bar is accomplished by repetitive lifting from any of a number of positions, with weights being added to the ends of the bar to increase the passive resistance to the lifting exercise. Hence, the conventional exercise bar functions as a constant, passive, resisting force to the exercise. A conventional bar is designed for optimum securement of free weights, rather than as a dynamic participant in the exercise.

A number of exercise bars have been proposed in the past which vary the design of the straight conventional exercise bar, but are functionally similar to a conventional straight exercise bar. Patents illustrating these prior units include U.S. Pat. Nos. 2,508,567; 2,722,419; 4,288,073; and 3,904,198. Some of these prior art exercise bars incorporate various bar configurations in which the weights are secured along one centerline of the device and the hands are positioned on a second centerline of the device. Various advantages accrue by using this two centerline concept, for example, the body may thereby be placed in a better position for exercise or the configuration of the bar might allow performance of exercises that cannot be carried out on a conventional straight exercise bar. However, these prior art exercise bars function in essentially the same way as conventional straight exercise bars, that is, they simply provide a constant passive resistance to repetitive lifting exercise. These prior art exercise bars, by providing constant passive resistance to a repetitively applied force, are useful in strengthening and defining like muscle groups. These prior art units, however, are not capable of providing a dynamic, variable resistance to an exercising movement and do not provide for the simultaneous balanced exercise of contralateral muscle groups.

SUMMARY OF THE INVENTION

The limitations outlined above are in large measure solved by the exercise bar (and method) in accordance with the present invention. That is to say, the exercise bar hereof is not merely a constant, passive resisting force to a repetitive lifting exercise, but rather is a dynamic participant in the exercise by virtue of the bar's relative movement. The construction of the bar hereof, and its relative movement during use, provides a dynamic variable resistance, which effectively simultaneously exercises contralateral antagonist muscle groups. Conventional free weights may be added to the exercise bar as desired, to increase the range of the variable resistance provided by the bar during exercise. Use of the exercise bar of the present invention provides a dynamic, variable resistance to muscle exertion, producing continuous, simultaneous and balanced exercise of contralateral muscle groups.

The exercise bar in accordance with the present invention broadly includes an elongated, central section having a pair of spaced, opposed, elongated, handgrip portions affixed at each end of the central section. The longitudinal axes of the central section, and handgrip portions are spaced apart and parallel relative to each other, thereby defining three, separate, parallel centerlines, namely: a central section centerline, a first handgrip portion centerline, and a second handgrip portion centerline. Preferably, the three centerlines of the bar all lie substantially in the same plane, with the first and second handgrip portion centerlines located on opposite sides of the central section centerline and equidistantly spaced therefrom.

In particularly preferred forms, the bar hereof incorporates structure which allows for the addition or subtraction of weights to the bar. Preferably, the weight-receiving structure of the exercise bar is in the form of a pair of spaced, opposed, elongated, generally cylindrical in cross-section bars coaxial with the central section centerline and affixed outboard of the respective handgrip portions. This configuration allows for conventional free weights to be added, if desired, to the weight-receiving bars such that the weights are positioned along the central section centerline. Additionally, the handgrip portions respectively incorporate elongated, tubular handles revolubly mounted around the handgrip portions. In use, the bar is grasped at the handles and lifted, and rotated clockwise or counterclockwise about the central section. The bar is positioned relative to the body depending on the muscle groups to be exercised (e.g., curl, overhead, supine, etc.).

DESCRIPTION OF THE PREFERRED EMBODIMENT

Figure 1:
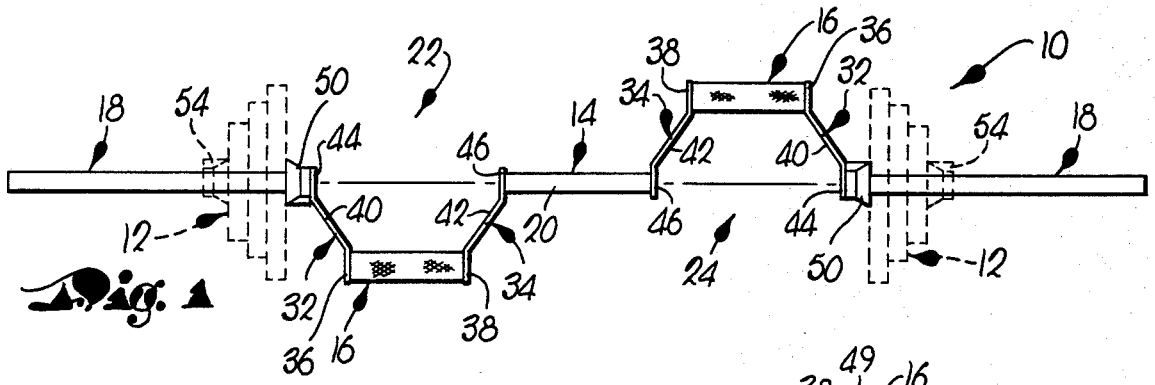
FIG. 1 is an elevational view of the exercise bar of the present invention, with conventional free weights shown in phantom.

Referring now to the drawing, an exercise bar 10 for use, if desired, with conventional free weights 12 is illustrated. The exercise bar 10 in accordance with the present invention broadly includes an elongated, rectilinear, central section 14, a pair of spaced, opposed, elongated, rectilinear handgrip portions 16 respectively affixed outboard of the central section 14, and a pair of spaced, opposed, elongated, generally cylindrical in cross-section, weight-receiving members 18 respectively secured outboard of the handgrip portions 16. The central section 14 preferably comprises an elongated, solid, cylindrical in cross-section core 20, which serves to interconnect the first half 22 and second half 24 of the bar 10. The first half 22 and second half 24, separated by core 20, are identical in every detail, but are disposed 180° relative to each other. Therefore, in describing the bar 10, only the details of the first half 22 will be described, it being understood that the details of first half 22 are identical in all respects to the second half 24, even though the structure of halves 22, 24 are rotated 180° relative to each other.

Figure 2:
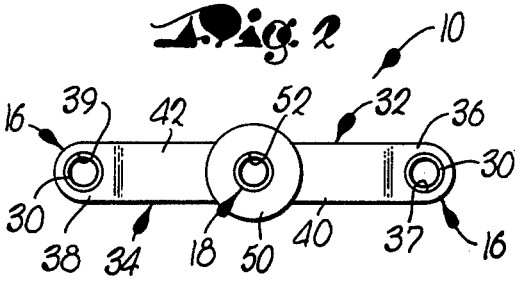
FIG. 2 is an end view of the exercise bar illustrated in FIG. 1.
Figure 3:
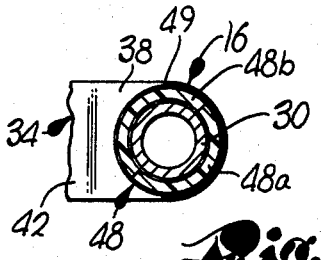
FIG. 3 is a fragmentary vertical sectional view of a handgrip portion of the device depicted in FIG. 1.

In more detail, the handgrip portion 16 includes an elongated, cylindrical in cross-section, tubular journal 30, preferably formed of a metal material. Elongated, flattened, obliquely-oriented brackets 32, 34, are secured to the respective ends of journal 30. As seen in FIGS. 1–2, the brackets 32, 34 present a first member 36, 38, respectively, having circular apertures 37, 39 extending therethrough dimensioned for sliding reception of the distal ends of journal 30. The ends of journal 30 are received in apertures 37, 39 and the journal 30 fixedly secured between brackets 32, 34 (as by welding). Advantageously, the brackets 32, 34 are oriented in the same radial direction relative to journal 30. Second members 40, 42 are integrally connected with first members 36, 38 and obliquely-oriented thereto. The brackets 32, 34 terminate at third members 44, 46 which are respectively parallel with first members 36, 38. As seen in FIG. 1, the bracket 34 interconnects the central section 14 to the journal 30, with the third member 46 fixedly secured to the core 20 and the first member 38 fixedly secured to the journal 30. The bracket 34 interconnects journal 30 and central section 14 such that the longitudinal axes of central section 14 and journal 30 are parallel. Bracket 32 in similar fashion interconnects journal 30 with weight-receiving member 18, that is, the end of journal 30 is received in aperture 37 and fixedly secured to member 36, while third member 44 is fixedly secured to the distal end of weight-receiving member 18. The securement of bracket 32 between member 18 and journal 30 orients the longitudinal axes of member 18 and journal 30 offset and parallel to each other. The brackets 32, 34 are preferably similarly dimensioned and affixed in similar fashion to journal 30 so that, as seen from FIG. 1, the longitudinal axes of central section 14 and weight-receiving member 18 are coaxial.

In addition, handgrip portion 16 preferably includes an elongated, cylindrical in cross-section, tubular handle 48 revolubly mounted on journal 30 between the brackets 32, 34. Handle 48 is preferably composed of a synthetic resin material, and is formed on journal 30 by heat treating identical, semicircular shaped halves **48*a*, 48*b*. Advantageously, the handle 48 is encapsulated in a rubber-like sheathing 49**.

The elongated, cylindrical in cross-section weight-receiving member 18 is secured to the bracket 32 as at member 44, as described above, and is preferably composed of a metallic material. A frustoconically shaped hub 50 is centrally apertured as at 52 for sliding reception on to member 18 until the hub abuts the bracket 32. In this fashion, apertured free weights 12 can be slidingly received on member 18 in the quantity desired, until the weights 12 adjoin the hub 50. Advantageously, the weights are retained on the bar 10 by a centrally apertured, frustoconicalshaped hub 54, similar to hub 50, slidingly received over member 18 into contact with weights 12. The hub 54 can be secured in place by conventional means, as by a set screw turnbuckle (not shown).

Figure 4:
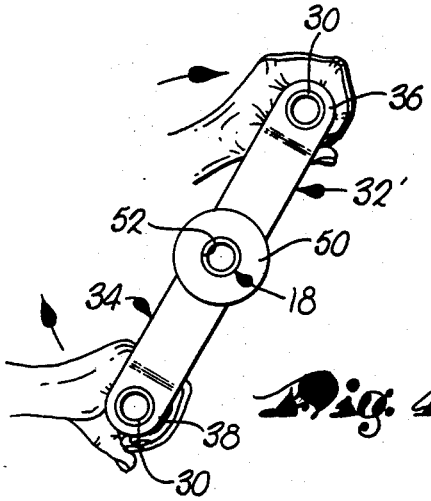
FIG. 4 is an end view of the device illustrated in FIGS. 1–3, during use.

As seen in FIGS. 1, 2, and 4, the weight-receiving members 18 and the central section 14 all have coaxial longitudinal axes. In this regard, the handgrip portions 16 are affixed to the central section 14 such that the central section 14 and the handgrip portions 16 all lie in the same plane (see FIGS. 2 and 4). The handgrip portions 16, while co-planar, are affixed on opposite sides of the central section 14 such that the longitudinal axes of the handgrip portions 16 and central section 14 define three separate parallel centerlines.

Figure 7:
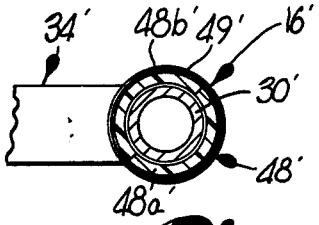
FIG. 7 is a fragmentary vertical sectional view of a handgrip portion of the embodiment depicted in FIGS. 5–6.
Figure 6:
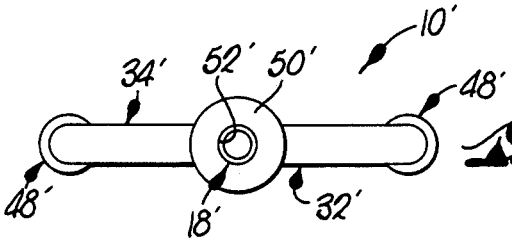
FIG. 6 is an end view of the embodiment illustrated in FIG. 5.
Figure 5:
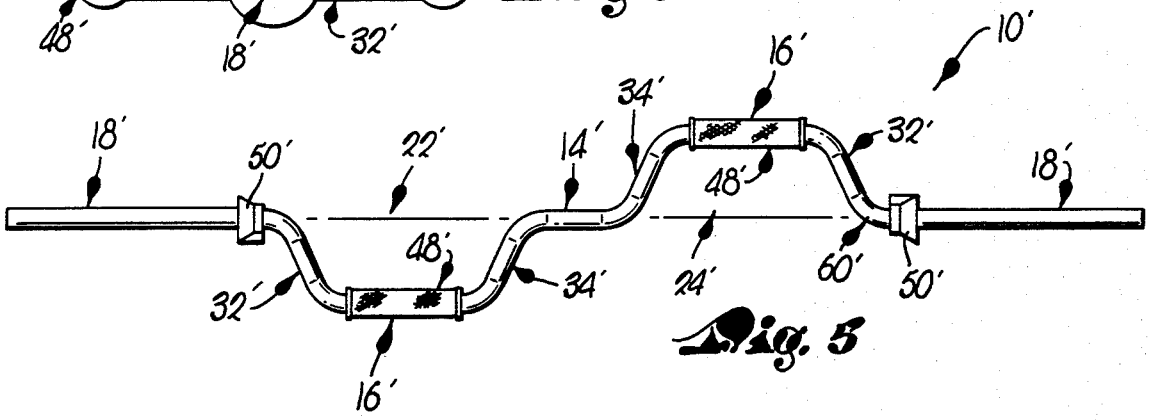
FIG. 5 is an elevational view of an alternative embodiment of the present invention.

In FIGS. 5–7 an alternative embodiment of the invention is depicted. The design of the embodiment in FIGS. 5–7 is similar to that of the preferred embodiment illustrated in FIGS. 1–4, with the difference being primarily in the method of construction. Accordingly, the same reference numerals are used for similar components, with the prime (') symbol denoting a reference to the embodiment illustrated in FIGS. 5–7. That is, while the preferred embodiment incorporates a central section 14, handgrip portions 16 and weight-receiving members 18 as component pieces which are assembled (as by welding), the exercise bar 10' of the alternative embodiment is formed by bending an elongated, straight, cylindrical in cross-section bar 60' to form the respective handgrip portions 16'. In this regard, the bracket sections 32', 34' are simply obliquely bent sections of the bar 60', interconnecting the member 18', handgrip portion 16' and central section 14'. In similar fashion, a handle 48' is revolubly mounted around the handgrip portion 16' between the bracket portions 32', 34' of bar 60'.

In use, the exercise bar of the present invention is grasped by the hands at the handles 48 as shown in FIG. 4, and positioned relative to the body for the exercise desired, for example, the bench press, arm curl, or overhead press. The exercise bar 10 is then rotated in either a clockwise or counterclockwise direction about the relatively stationary central section 14. The handgrip portions 16 are interconnected to the weight-receiving members 18 by obliquely-oriented brackets, as at 32, to provide for forearm clearance during rotation of the bar 10. This rotation of the exercise bar 10 allows the bar 10 to become an active, dynamic, participant in the exercise, instead of merely providing a passive, constant resistive force. In general terms, it is seen that by rotating the bar 10 about the central section 14, the extension of the arms away from the body is constantly changing. Thus, each arm encounters a constantly changing force vector, by virtue of the constantly changing moment, thereby establishing a variable, dynamic resistive force in the exercise process. Additionally, different muscle groups are emphasized according to the relative extension of each arm. As those skilled in the art will appreciate, rotating the exercise bar 10 in different directions emphasizes different muscle groups. Likewise, changing the position of the exercise bar 10 relative to the body (for example, front, overhead, and supine), also emphasizes different muscular groups. It will be appreciated that this dynamic resistance allows for balance, simultaneous exercise of contralateral antagonist muscle groups.

It has been found that the invention hereof while useful in all exercise programs, is particularly helpful in the field of rehabilitative medicine. The invention hereof provides substantial tension to the forearm, shoulder, back, and chest musculature and is particularly effective in exercising and strengthening the extensor muscles of the forearm. Additionally, the exercise bar of the present invention is particularly helpful in developing the balanced strength of the musculature in the shoulder joints, a frequent source of sports related injuries. The exercise bar of the present invention forces the balanced development of the muscles of the shoulder rotator cuff and pectoralis by requiring the operator to exercise the muscles through a 360° arc against a dynamic resistive force.

I claim:

1. An independently operable, freely movable, rotatable exercise bar for providing variable, dynamic resistive force during use thereof comprising:

an elongated central section;

a handgrip portion affixed to each end of the central section, the longitudinal axes of the central section and each of said handgrip portions being spaced apart and generally parallel with each other, said three axes being substantially coplanar, the handgrip portions being equidistantly spaced from said central section;

an outwardly extending, weight receiving member affixed to each of the handgrip portions opposite to said central section, the outer end of each of said weight receiving members being free, whereby free weights may be selectively placed over each said free end and on each of said weight receiving members and secured thereto; and hubs for placement on each of said weight receiving members respectively, and on opposite sides of free weights thereon, for securing the free weights on their corresponding weight receiving members.

2. An independently operable, freely movable, rotatable exercise bar for providing a variable, dynamic resistive force during use thereof as set forth in claim 1, the longitudinal axes of the weight receiving members being coaxial with the longitudinal axis of the central section.

3. An independently operable, freely movable, rotatable exercise bar for providing variable, dynamic resistive force during use thereof as set forth in claim 1, each of said handgrip portions being fixedly secured between the central section and its corresponding weight receiving member by obliquely oriented connector elements.

4. An independently operable, freely movable, rotatable exercise bar for providing variable, dynamic resistive force during use thereof as set forth in claim 3, each of said handgrip portions having a handle revolvably mounted thereon.

5. An independently operable, freely movable, rotatable exercise bar for providing variable, dynamic resistive force during use thereof as set forth in claim 1, there being a pair of hubs on each weight receiving member, one of said hubs normally being proximal to its corresponding handgrip, the other hub being spaced toward the free end of the weight receiving member.

6. An independently operable, freely movable, rotatable exercise bar for providing variable, dynamic resistive force during use thereof as set forth in claim 5, free weights being apertured to slidably receive the free end of a corresponding weight receiving member therethrough for movement along the weight receiving member, the hubs being apertured for placement over the free, outer ends of the weight receiving members.

7. An independently operable, freely movable, rotatable exercise bar for providing variable, dynamic resistive force during use thereof as set forth in claim 6, said exercise bar being formed from a single length of cylindrical material.

* * * * *